US006339283B1

(12) United States Patent
Horiuchi

(10) Patent No.: US 6,339,283 B1
(45) Date of Patent: Jan. 15, 2002

(54) FRAME FOR USE IN COLOR SELECTION MECHANISM OF CATHODE RAY TUBE, COLOR SELECTION MECHANISM OF CATHODE RAY TUBE, CATHODE RAY TUBE, AND METHOD OF MANUFACTURING FRAME FOR USE IN COLOR SELECTION MECHANISM OF CATHODE RAY TUBE

(75) Inventor: Yoshiro Horiuchi, Tokyo (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/499,611

(22) Filed: Feb. 7, 2000

(51) Int. Cl.[7] ..... H01J 29/80
(52) U.S. Cl. ..... 313/407; 313/402; 445/30
(58) Field of Search ..... 313/402, 407; 445/30

(56) References Cited

U.S. PATENT DOCUMENTS 6,054,803 A * 4/2000 Saita ..... 313/402
6,111,349 A * 8/2000 Kuwana et al. ..... 313/407

FOREIGN PATENT DOCUMENTS

JP 11-339680 * 12/1999

* cited by examiner

*Primary Examiner*—Sandra O'Shea
*Assistant Examiner*—Ali Alavi
(74) *Attorney, Agent, or Firm*—Ronald P. Kananen; Rader, Fishman & Grauer PLLC

(57) ABSTRACT

A frame for use in a color selection mechanism of a cathode ray tube, the frame having a pair of mutually opposing supporting members that has fixedly mounted thereover a color sorting electrode thin plate and elasticity-imparted members each bridged over the corresponding one ends of the supporting members. The frame has a welding gas degassing vent hole that is formed at a position of the supporting member at which the elasticity-imparted member is welded thereto. As a result of this, it is possible to prevent the occurrence of the problems that, after the assembly of the cathode ray tube, the welding gas, the rustproofing oil, etc. are oozed, shot blast balls remain to exist, etc. It is thereby possible to provide a frame for use in a color selection mechanism of the cathode ray tube wherein any defects are prevented from occurring in the tube, such as deterioration of the characteristics, abnormal discharge, etc.

6 Claims, 7 Drawing Sheets

FRAME FOR USE IN COLOR SELECTION MECHANISM OF CATHODE RAY TUBE, COLOR SELECTION MECHANISM OF CATHODE RAY TUBE, CATHODE RAY TUBE, AND METHOD OF MANUFACTURING FRAME FOR USE IN COLOR SELECTION MECHANISM OF CATHODE RAY TUBE

BACKGROUND OF THE INVENTION

1. Field of the Invention

The present invention concerns a color selection mechanism used in a color cathode ray tube, a frame for use in the color selection mechanism, a cathode ray tube equipped with the color selection mechanism, and a method of manufacturing the frame for use in the color selection mechanism.

2. Description of the Related Art

As a color selection mechanism for use in a color cathode ray tube, for example, there is known a color selection mechanism 51, called "an aperture grill," such as that illustrated in FIG. 1. This color selection mechanism 51 has provided therein a frame 56 for use in a color selection mechanism, whose skeletal structure is shaped like a framework, and which is hereinafter referred to simply as "a frame". The frame 56 is composed of a pair of supporting members 52 and 53 that are arrayed in parallel in such a way as to oppose each other and elasticity-imparted members 54 and 55, each of which is bridged over the corresponding ends of the supporting members 52 and 53 (and which sometimes for brevity are hereinafter referred to simply as "elastic members"). This frame 56 is constructed in such a form wherein a color sorting electrode thin plate (hereinafter referred to simply as "a thin plate") 60, having a large number of slit-like electron beam apertures (hereinafter referred to simply as "apertures" 59) in one direction, i.e., in the horizontal direction of the screen, is mounted or bridged over the mutually opposing and parallel arranged supporting members 52 and 53 of the frame 56.

The thin plate 60 is constructed in such a form wherein a large number of small-width and strip-like grid elements 58 each comprising a metal thin sheet are arrayed at prescribed intervals in said one direction; and the apertures 59, each having an opening in the vertical direction of the screen are formed between the mutually adjoining grid elements 58. The thin plate 60 is also constructed in such a form wherein the grid elements 58 are bridged over the supporting members 52 and 53, with some extent of tension being imparted thereto by the elastic members 54 and 55.

In this color selection mechanism 51, in order to prevent the grid elements 58 from being vibrated, damper wires 57 are mounted in the array direction of the grid elements 58, so as to contact with the surface of the thin plate 60. The reference symbol 61 represents damper springs for imparting a tension to the damper wires 57.

In addition, although not illustrated, springs for example are respectively attached to the supporting members 52, 53 and the elastic members 54, 55. Through the intermediary of these springs, the color selection mechanism 51 is fixed to the panel of the body of the cathode ray tube.

The supporting members 52, 53 in the long-side direction of the frame 56 and the elastic members 54, 55 in the short-side direction thereof are connected together by welding. Both of these members are assembled in the form of parallel crosses to thereby construct the frame 56.

FIG. 2 and FIGS. 3A to 3D illustrate the schematic construction of a conventional frame 56 that is used in the color selection mechanism 51 of FIG. 1.

As illustrated in FIGS. 2 and 3A to 3D, the frame 56 is constructed in such a form wherein elemental members that comprise a pair of long-side frame members 52, 53 and a pair of short-side elastic members 54, 55 are assembled together in the form of parallel crosses. These both elemental members are connected together by welding, e.g., Tig welding (arc welding that is performed in the atmosphere of an inert gas by using metal such as tungsten as a welding electrode).

As illustrated in FIG. 3A, each of the supporting members 52, 53 has a substantially L-shaped section, and is formed such that, as illustrated in FIG. 3C, the upper and bottom surfaces of each of these members have a prescribed radius of curvature.

As illustrated in FIG. 3B, each of the elastic members 54, 55 is configured such that an angular member used as the elastic member 54, 55 is bent at the positions near the ends thereof, becoming future joint portions. Each elastic member, as illustrated in FIG. 3D, is formed substantially into a shape of horizontally thrown U. And, the ends of each elastic member 54, 55 are connected to the corresponding one-end bottom surfaces of the supporting members 52, 53 by welding.

Welding is done with respect to four positions, respective left end and right end portions of the upper and lower supporting members 52, 53 in FIG. 2.

And, as illustrated in FIG. 4A an enlarged view of the joint portion and its neighborhood of the elastic member 54, 55, in with four surfaces 65*a*, 65*b*, 65*c*, and 65*d* corresponding to four sides of the end surface 65, which becomes a future welded portion of the elastic member 54, 55, with one surface 65*d* being made weld-free. Namely, with this one surface 65*d* being kept not welded, a clearance is instead formed correspondingly thereto. And welding is done with respect to the remaining three surfaces 65*a*, 65*b*, and 65*c*.

For example, as with the welded range and the welding direction illustrated in FIG. 4B, welding is done with respect to the three surfaces 65*a*, 65*b*, and 65*c* in this order.

As a result of this, in the post-welding state illustrated in FIG. 5, with the clearance remaining at the illustrated portion 66, the inert gas that generates when doing welding has hitherto been removed from this clearance 66.

However, when the clearance 66 that corresponds to the above-described weld-free portion is large, in a thereafter succeeding removing step of oxide scales that have occurred in an annealing step of the frame 56 for use in color selection mechanism, rust of the frame 56, etc., there arises the problem that shot blast balls for use in this removal will be carried through the clearance 66.

For this reason, 100% inspection is visually performed with respect to the entire frame 56 about the entry of the shot blast balls. In a case where shot blast balls remain within the clearance 66, take-out of these shot blast balls is performed. In frame 56 from which shot blast balls have been removed is put into use.

However, even when inspection has been performed with respect to the entire frame 56, by missing shot blast balls during the inspection, it is also possible that shot blast balls will be discovered in the clearance 66 in the course of the thereafter succeeding manufacturing process of the cathode ray tube.

When in this way having formed a cathode ray tube with shot blast balls remaining therein, for example, abnormal discharge may occur due to the shot blast balls when the cathode ray tube is operated. Namely, the shot blast balls contained therein may have serious effects on the withstand voltage characteristic of the cathode ray tube.

Also, it is possible that the rustproofing oil that is used in the rustproofing step will be carried into the clearance 66. Usually, the rustproofing oil that has been carried in comes out from the clearance 66 and vaporizes when performing heat treatment in the annealing step (so-called "blackening") of the frame.

However, in a case where the clearance 66 is narrow, even when entry of the rustproofing oil occurs, this oil does not come out from the clearance 66 and vaporize during the annealing step. Instead, there may occur a case where this oil comes out when vacuumization is done in the manufacturing step of the cathode ray tube, etc.

On the other hand, in a case where all of the four surfaces 65*a*, 65*b*, 65*c*, and 65*d* corresponding to the four sides of the end surface 65 of the elastic member 54, 55 have been welded without providing a zone that is made weld-free, no clearance 66 is formed at the side portions of the end surface 65.

When manufacturing the cathode ray tube with this clearance 66 not provided, the welding gas remains between the elastic members 54, 55 and the bottom surfaces of the supporting members 52, 53. As a result, after having manufactured the cathode ray tube, it is possible that during the use thereof the welding gas will ooze out, owing to the aging, from the frame 56 into the body of the cathode ray tube.

As a result of this, the degree of vacuum within the cathode ray tube deteriorates and this has adverse effects on the cathode. It also results from this that the service life of the cathode ray tube becomes short.

In view of the above, the standard of the clearance 66 for degassing is defined as being that a clearance 66 whose size is large enough to enable degassing be ensured; and there be no entry of shot blast balls. However, in the conventional structure, there is the likelihood that the entry of shot blast balls will be missed, and so it becomes necessary to perform 100% inspection. As a result, the productivity of the frame 56 and hence, the cathode ray tube are lowered.

SUMMARY OF THE INVENTION

The present invention provides a frame for use in a cathode ray tube, the frame having mounted thereover a thin plate of the cathode ray tube, which frame comprises a pair of mutually opposing supporting members that has fixedly mounted thereover the thin plate, elastic members each bridged over the corresponding ends of the supporting members, and welding gas degassing vent holes that are each formed at a position of the supporting member at which the elastic member is welded thereto.

Also, the present invention has a construction wherein in the frame for use in the cathode ray tube the welding gas degassing vent hole is located almost right above the center of the end surface, becoming a joint portion of the elastic member.

Also, the present invention has a construction wherein in the frame for use in the cathode ray tube the welding gas degassing vent hole is kept closed.

The present invention provides a color selection mechanism of a cathode ray tube, the color selection mechanism having a frame that has mounted thereover a thin plate, which frame comprises a pair of mutually opposing supporting members that has fixedly mounted thereover the thin plate, elastic members each bridged over the corresponding ends of the supporting members, and welding gas degassing vent holes that are each formed at a position of the supporting member at which the elastic member is welded thereto.

The present invention provides a cathode ray tube comprising a color selection mechanism that has a frame having mounted thereover a thin plate, which frame comprises a pair of mutually opposing supporting members that has fixedly mounted thereover the thin plate, elastic members each bridged over the corresponding ends of the supporting members, and welding gas degassing vent holes that are each formed at a position of the supporting member at which the elastic member is welded thereto.

According to the frame of the cathode ray tube, the color selection mechanism of the cathode ray tube, and the construction of the cathode ray tube of the present invention, the welding gas degassing vent hole is formed at the position of the supporting member at which the elastic member is welded thereto. As a result of this, it is not necessary to provide the weld-free portion for degassing the welding gas at the end portion of the elastic member at which the supporting member is welded thereto, i.e., the welding portion thereof. Therefore, even when welding is done with respect to the entire one-full circumference of the end portion, it is possible to sufficiently degas the welding gas so that no welding gas may remain during the manufacturing process of the cathode ray tube or after the manufacture of it.

Also, since there is no need to provide the weld-free portion at the welding portion, no shot blast balls, rustproofing oil, dust, etc. enter from the weld-free portion. It is therefore possible to prevent these shot blast balls, rustproofing oil, dust, etc. from remaining in the frame during the manufacturing process of the cathode ray tube or after the manufacture of it.

The present invention provides a method of manufacturing the frame for use in the cathode ray tube, the method comprising a step of forming the welding gas degassing vent hole at each of the joint portions of the supporting members to the elastic members, a step of welding the elastic members to the supporting members, and a step of closing the welding gas degassing vent hole after the execution of this welding step.

According to the above-described manufacturing method of the present invention, with the welding gas degassing vent hole being formed open, the welding step is performed. It is therefore possible to sufficiently degas the welding gas and thereby prevent the welding gas from oozing out into the cathode ray tube during the manufacturing process of this tube or after complete production thereof.

Also, by closing the welding gas degassing vent hole after the welding step, it is possible to prevent the occurrence of problems such as ooze-out of the welding gas, rustproofing oil, etc., remaining shot blast balls, etc. after the assembly of the cathode ray tube. Therefore it is possible to prevent the occurrence of any defects in the cathode ray tube, such as deterioration of the characteristic, abnormal discharge, and to enhance the quality of the cathode ray tube.

At this time, since shot blast balls cease to remain, it becomes unnecessary to perform 100% inspection with respect to the frame. Therefore, it is possible to increase the productivity of the frame, the color selection mechanism, and the cathode ray tube.

Figure 3A:
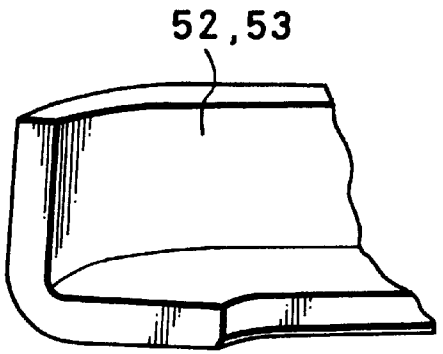
FIG. 3A is an enlarged view illustrating a part of a supporting member.
Figure 3B:
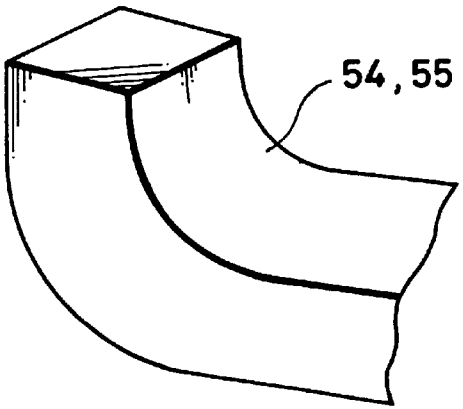
FIG. 3B is an enlarged view illustrating a part of an elastic member.
Figure 3C:
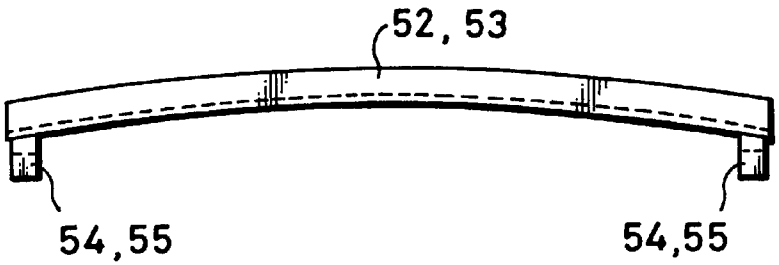
Figure 3D:
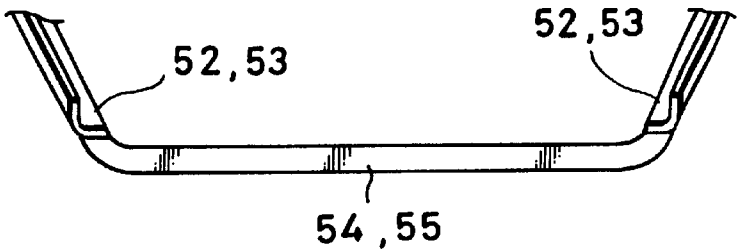
Figure 4A:
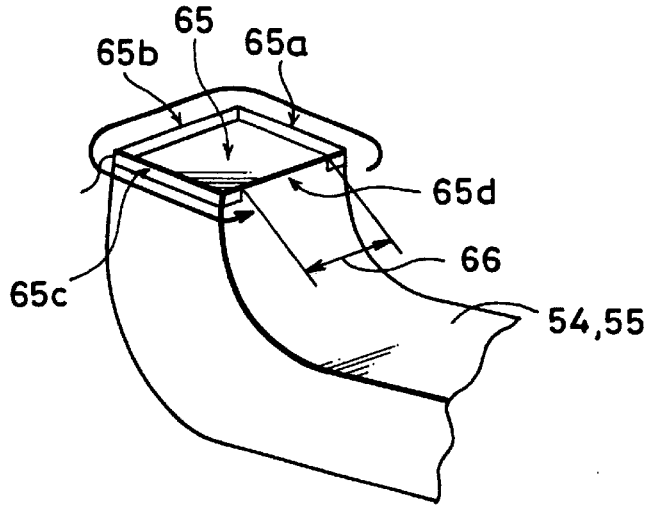
Figure 4B:
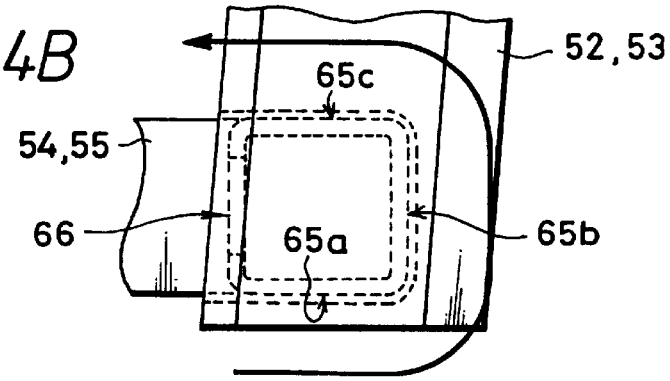
Figure 5:
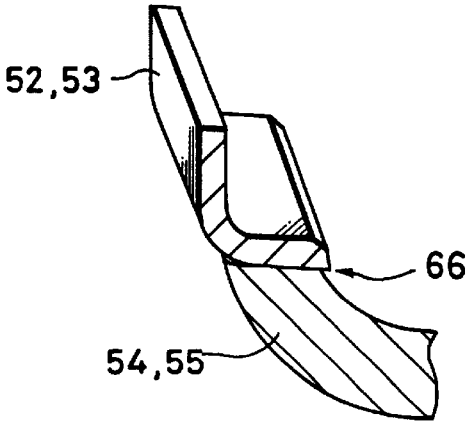
Figure 6:
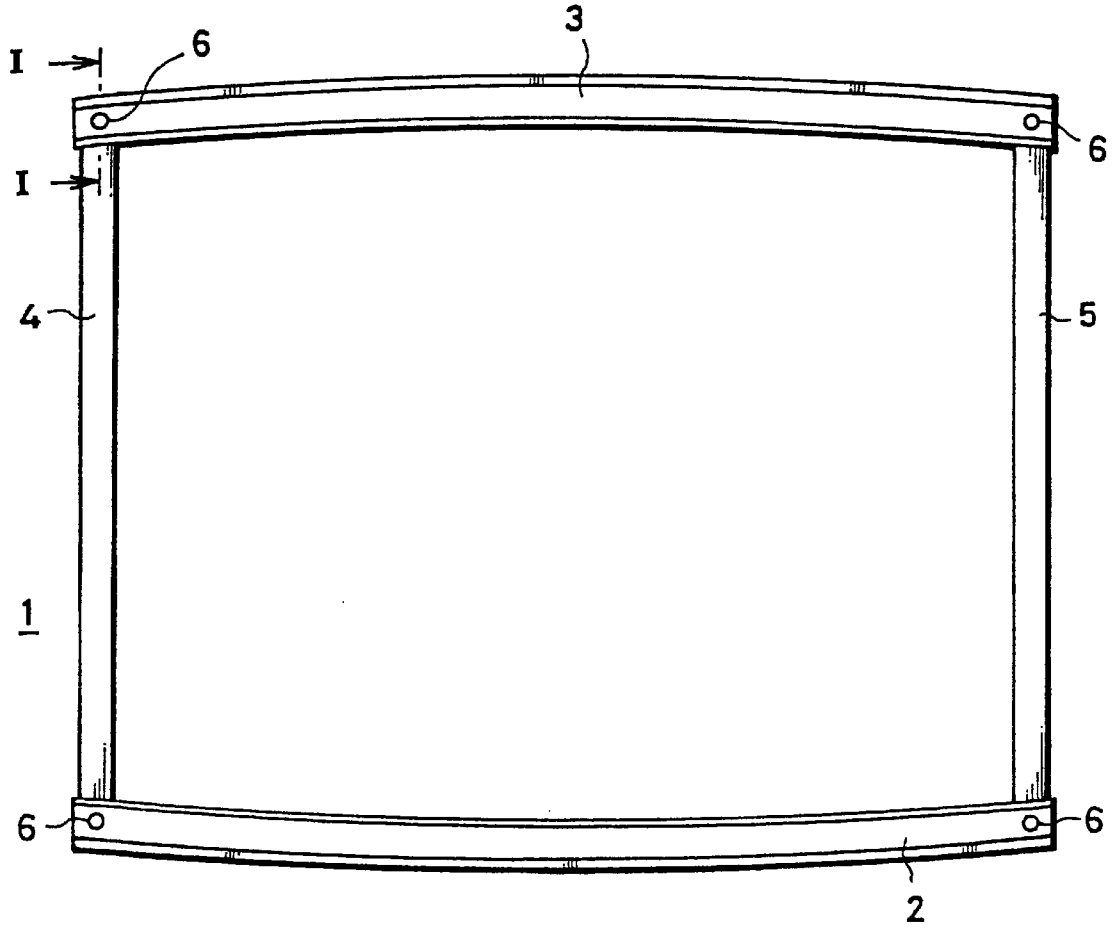
Figure 7:
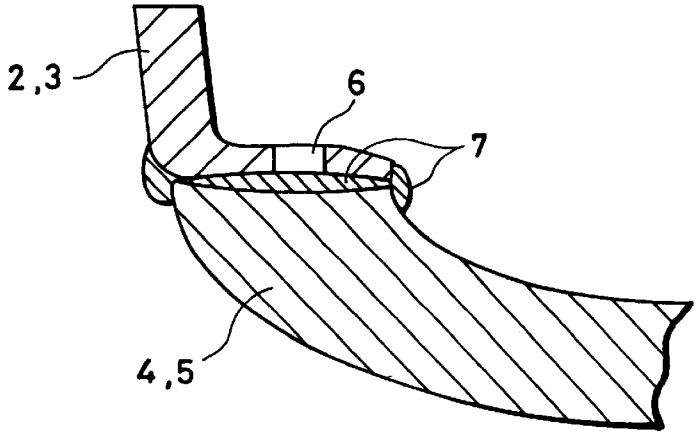

3C is a side view illustrating the supporting member;

FIG. 3D is a side view illustrating the elastic member;

FIG. 4A is a view illustrating a welded range of a conventional elastic member;

FIG. 4B is a plan view illustrating the welded range and welding direction of the conventional elastic member;

FIG. 5 is a view illustrating a state after welding of the supporting member and elastic member;

FIG. 6 is a plan view illustrating a frame of the present invention;

FIG. 7 is a sectional view taken along a line I—I of FIG. 6 i.e., a sectional view of a portion of connection of each of the supporting members 2, 3 with a corresponding one of the elastic member 4, 5.

Figure 8:
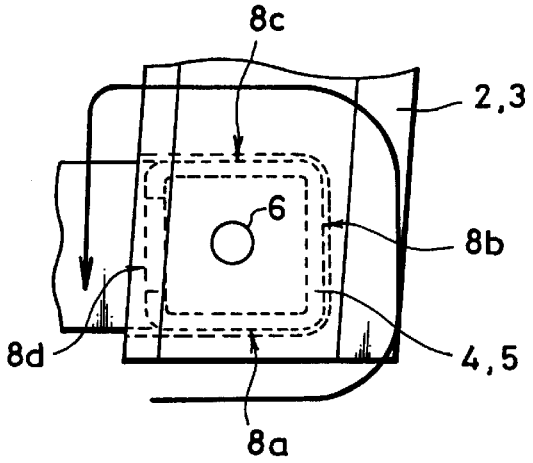
Figure 9A:
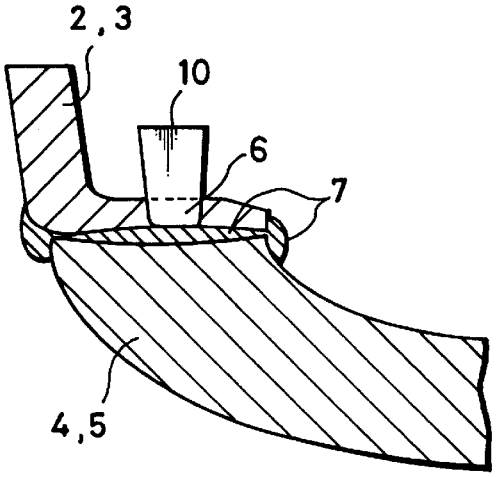
Figure 9B:
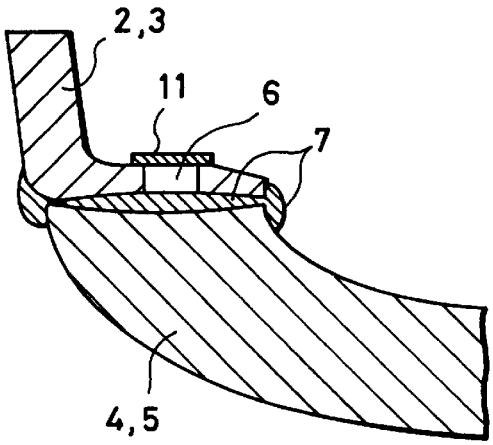
Figure 10:
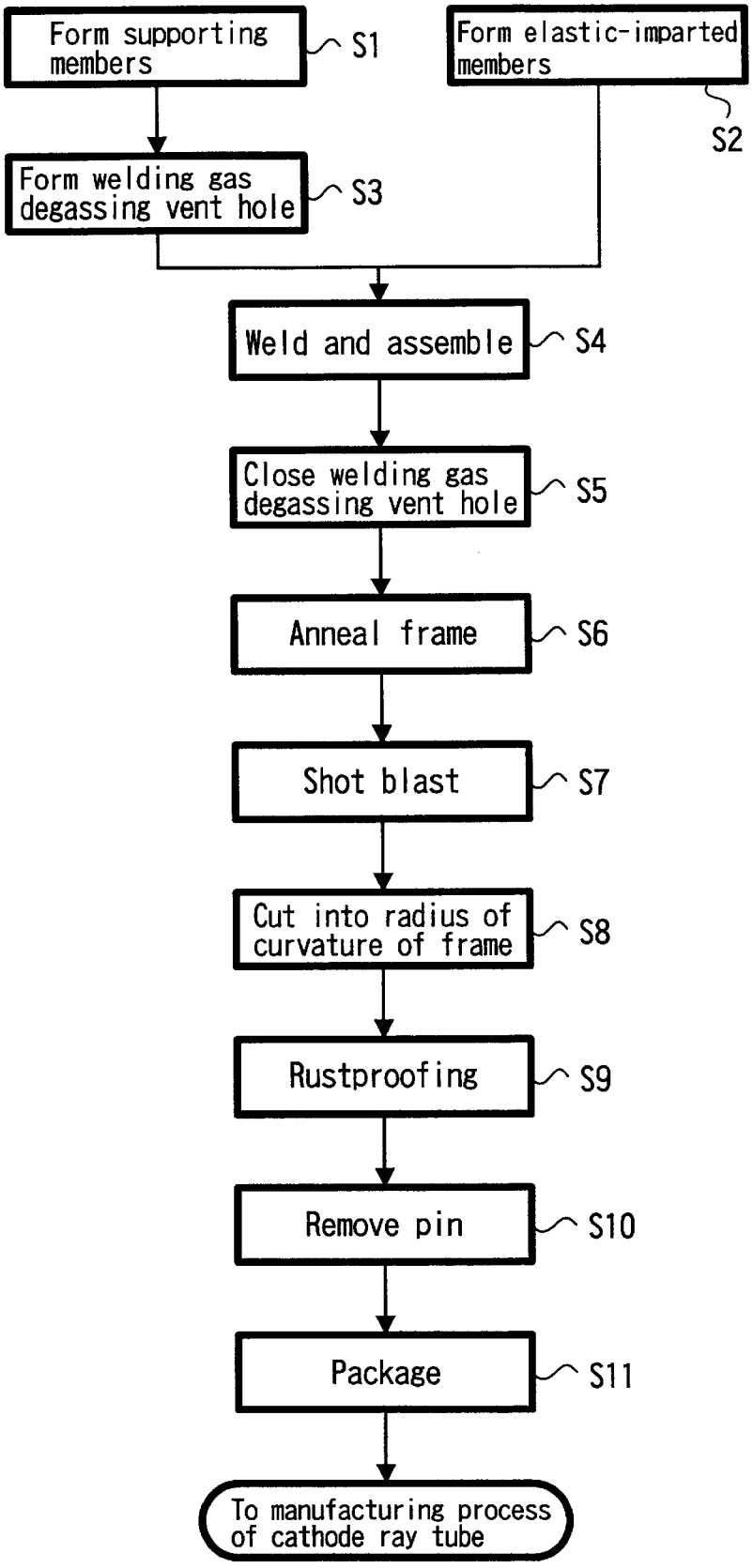

FIG. 8 is a view illustrating a welded range of the elastic member of the present invention;

FIG. 9A is a sectional view illustrating a first example of the way of closing a welding gas degassing vent hole;

FIG. 9B is a sectional view illustrating a second example of the way of closing a welding gas degassing vent hole; and FIG. 10 is a flow chart illustrating an example of a manufacturing process of the frame of the present invention.

DETAILED DESCRIPTION OF THE PREFERRED EMBODIMENT

As an embodiment of the present invention, a schematic construction of the frame (plan view) is illustrated in FIG. 6.

Figure 1:
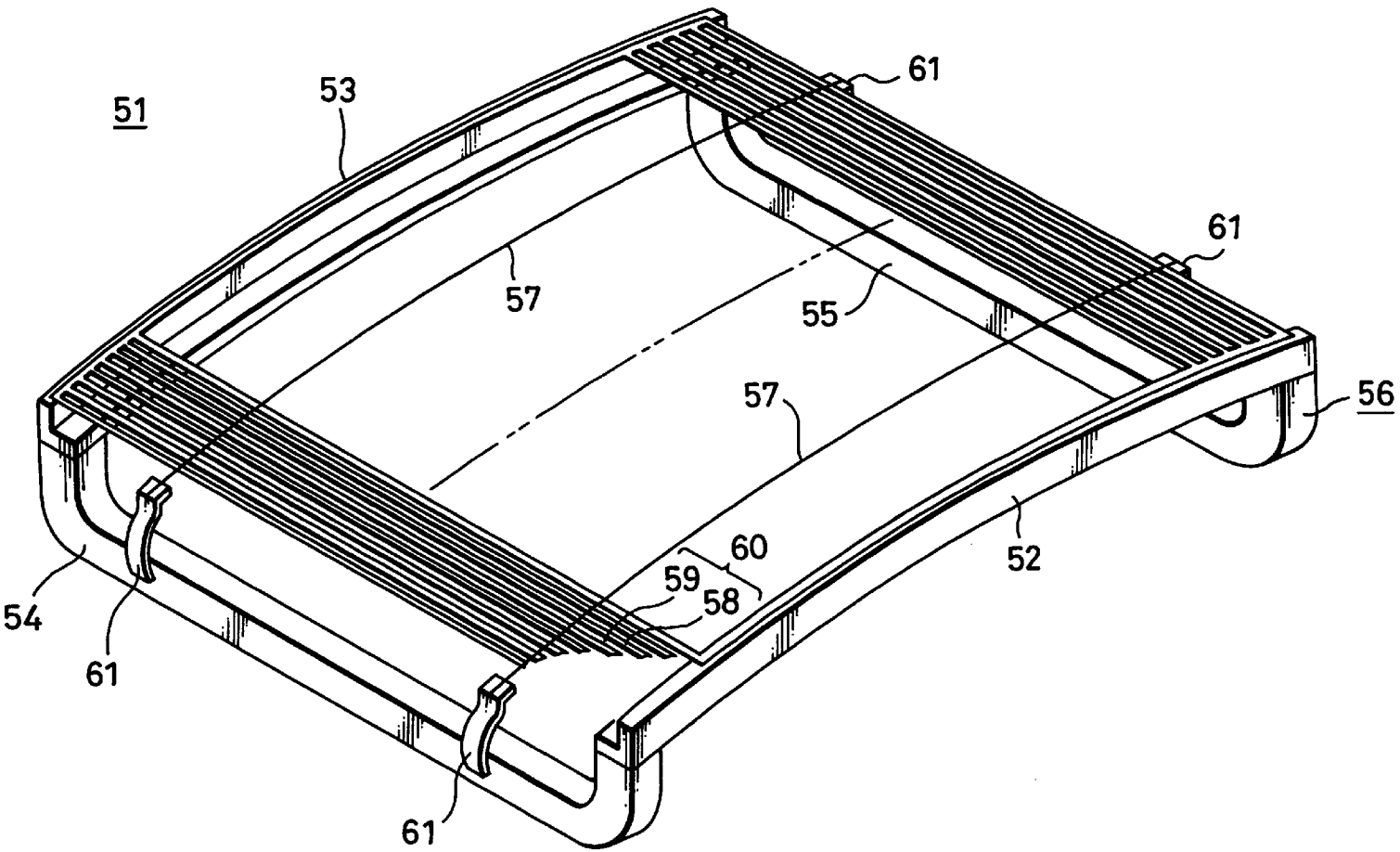
FIG. 1 is a constructional view illustrating a color selection mechanism of a cathode ray tube.
Figure 2:
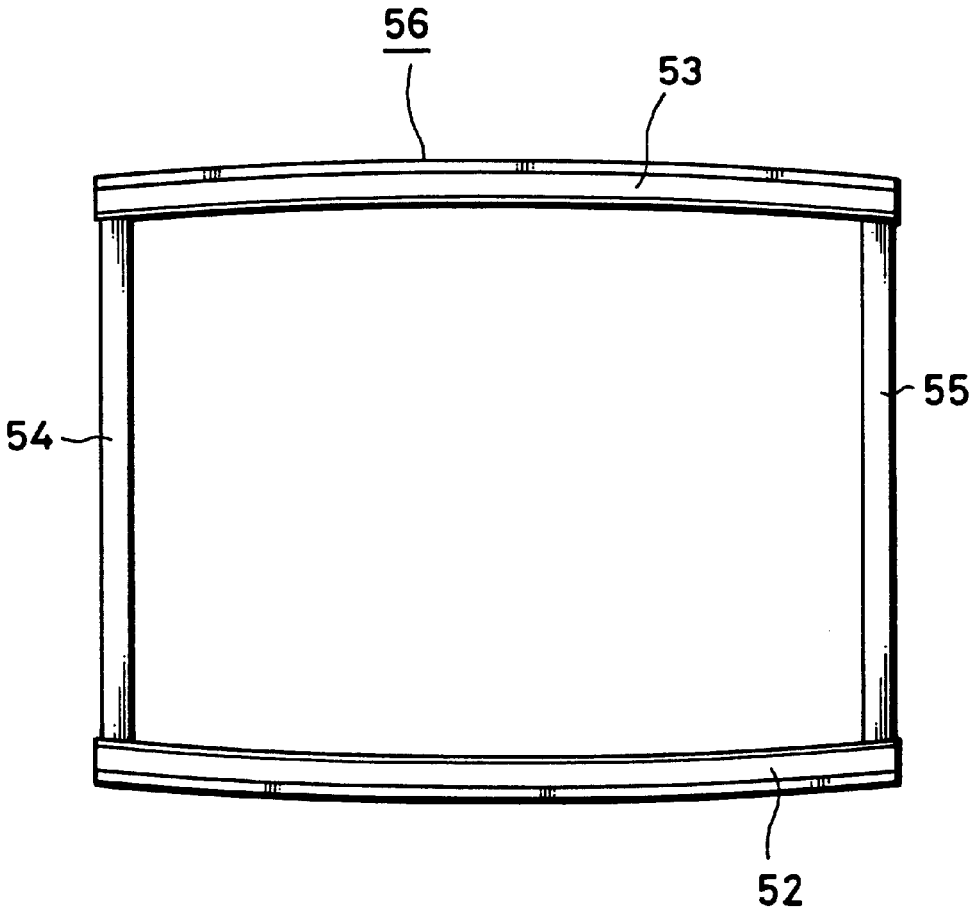
FIG. 2 is a plan view illustrating a conventional frame.

This frame 1 of a cathode ray tube is the one that constitutes a color selection mechanism of the cathode ray tube such as that 51 previously illustrated in FIG. 2. As illustrated in FIG. 6 in the form of a plan view, the frame 1 is constructed by its two supporting members 2, 3 and elastic members 4, 5 being assembled in parallel crosses.

These supporting members 2, 3 and these elastic members 4, 5 are joined together by welding.

FIG. 7 is a sectional view taken along a line I—I of FIG. 6, i.e., a sectional view of a portion of connection of each of the supporting members 2, 3 with a corresponding one of the elastic member 4, 5.

In this embodiment, as illustrated in FIGS. 6 and 7, a welding gas degassing vent hole 6 is formed in the portion of connection of the supporting member 2, 3 with the elastic member 4, 5.

When forming the welding gas degassing vent hole 6, the supporting members 2, 3 are first each formed and then the ends of each of the supporting member 2, 3 are each holed by, for example, pressing.

Preferably, the resulting hole is made to have a size larger than the thickness of the supporting member 2, 3. It is to be noted that in FIG. 7 the reference symbol 7 represents welding material that has been produced by the elastic member 4, 5 being fused when welding has been done.

The configuration of each of the respective details of the supporting member 2, 3 and elastic member 4, 5 other than the portion thereof at which the welding gas vent hole 6 is formed is the same as the configurations presented in FIGS. 9A and 9B which illustrates of the supporting member 2, 3 and elastic member 4, 5. Therefore a detailed explanation thereof is omitted.

As illustrated in FIG. 8 welding is performed with respect to the welding range illustrated in dotted lines. Namely, welding is performed with respect to the four surfaces 8*a*, 8*b*, 8*c*, and 8*d* corresponding to the four sides of the end surface of the elastic member 4, 5 that becomes the joint portion of the elastic member 4, 5. In other words, welding is performed with respect to the entire circumference of this end surface. The elastic member 4, 5 is thereby connected to the supporting member 2, 3.

Thereafter, as in the illustration made in the previous FIG. 6, a thin plate 60 is mounted onto the resulting frame in such a way as to bridge over the supporting members 2 and 3. The intended color selection mechanism is thereby obtained.

In this way, since welding is performed over the entire circumference of each of the elastic members 4, 5, there is no clearance 66 that was conventionally formed. Therefore, as later described, it is possible to prevent shot blast balls from being carried into the frame, or to prevent rustproofing oil from being impregnated thereinto.

Simultaneously, since the mechanical strength of the joint portion also is sufficiently ensured, it becomes possible to make the dimensions of the elastic members 4, 5 smaller. It is therefore possible to reduce the weight of the frame 1 and to reduce the cost of the material. Further it is also possible to reduce the weight of the color selection mechanism prepared by mounting the thin plate over the frame 1.

At this time, welding of the supporting members 2, 3 with respect to the elastic members 4, 5 is performed using, for example, Tig welding. This welding is performed, for example, in the weld direction indicated by the arrow in FIG. 8, namely over one full circumference from the surface 8a at the lower part of FIG. 8 to the surface 8d in the sequential order mentioned.

It is to be noted that preferably the welding gas degassing vent hole 6 is formed almost right above the center of the end surface becoming the joint portion of each of the elastic members 4, 5.

As a result of this, the distances between the welding gas vent hole 6 and the welded four surfaces 8*a*, 8*b*, 8*c*, and 8*d* become almost equal. In addition, some extent of distance is ensured between the welding gas degassing vent hole 6 and each of the welded portions, and therefore the mechanical strength therebetween is sufficiently ensured.

This welding gas degassing vent hole 6 is kept open until the welding process is ended, so as to sufficiently degas the inert gas that has been used for welding.

And, after the welding process is ended, the welding gas vent hole 6 is closed.

In order to close the welding gas vent hole 6, for example, as illustrated in the sectional view of FIG. 9A, it is sufficient to insert, for example, a pin 10 into the welding gas vent hole 6 so that no clearance may be created therein. The material constituting the member for closing the welding gas vent hole 6, such as the pin 10, is not limited in particular. However, it is necessary for this material not to be broken or damaged, even when shot blast balls used for removing oxide scales or rust have stricken thereupon.

Also, instead of inserting the pin 10, etc., as illustrated in the sectional view of, for example, FIG. 9B, a shield plate 11 may be mounted onto the supporting member 2, 3 by welding, etc. in such a way as to cover the welding gas vent hole 6.

It is to be noted that, after having closed the welding gas vent hole 6 after the end of the welding, the vent hole is kept closed until the rustproofing step of the frame 1 is ended after removal of oxide scales or rust made using shot blast balls.

As a result of this, no clearance 66 for degassing that was conventionally formed exists at the joint portion between the supporting member 2, 3 and the elastic member 4, 5. Therefore, in the thereafter succeeding manufacturing process, there arise no problems with shot balls, rustproofing oil, dust, and so forth, being carried into the welded portion.

Accordingly, it is possible to prevent any defects from occurring in the resulting cathode ray tube, such as deterioration of the characteristics, abnormal discharge, etc. And it is thereby possible to enhance the quality of the cathode ray tube.

Also, since shot blast balls cease to remain, it becomes unnecessary to perform 100% inspection with respect to the frame. As a result, it is possible to increase the productivity of the frame and the cathode ray tube.

Additionally, after the end of the rustproofing processing, the welding gas vent hole 6 may be either closed or kept open.

In the case where using the pin 10 illustrated in FIG. 9A, if the pin 10 is only inserted in without being fixedly bonded as is adhered, etc., it becomes also possible to remove the pin 10 afterwards.

Here, the manufacturing process of the above-described frame 1 is explained with reference to the flow chart of FIG. 10.

First, in step S1 of FIG. 10, there are formed the supporting members 2, 3.

In step S2, there are formed the elastic members 4, 5.

In step S3, in each of the both ends of the thus-formed supporting member 2, 3 there is opened the welding gas vent hole 6 by pressing, etc.

Next, in step S4, the supporting members 2, 3, having formed therein the welding gas vent hole 6, and the elastic members 4, 5, are assembled together by welding, such as Tig welding. A skeletal structure of the frame 1 is thereby formed.

At this time, as described above, the supporting member 2, 3 and the elastic member 4, 5 are welded together so that each of the four surfaces 8*a*, 8*b*, 8*c*, and 8*d* constituting the side surfaces of the end portion of the elastic member 4, 5 may be welded to the bottom surface of the supporting member 2, 3.

Next, in step S5, degassing holes 6 of the both ends of the supporting member 2, 3 are closed. As the member for closing this degassing hole 6 there is used the pin 10, the shield plate 11, and so forth as stated previously (see FIG. 9).

In the case when using the shield plate 11 as the hole 6 closing member, the shield plate 11 is welded to the supporting member 2, 3.

Next, in step S6, annealing of frame 1.

In step S7, as the shot blasting step, using the shot blast balls, oxide scales, dust, etc. that have occurred from annealing are removed.

At this time, since no clearance 66 that was conventionally formed exists, there is no possibility that shot blast balls will be carried into the frame 1.

Next, in step S8, cutting is done on the frame 1 in order to impart a prescribed radius of curvature to the frame 1.

Next, in step S9, using a rustproofing oil, etc., rustproofing processing is performed on frame 1. At this time, since no clearance 66 that was conventionally formed exists, there is no possibility that rustproofing oil will be impregnated or carried into the frame 1.

Next, in step S10, the pin 10 that has been inserted into the welding gas vent hole 6 is removed. This step of removing the pin 10 may be performed in the manufacturing process of the cathode ray tube that uses the frame 1.

It is to be noted that in a case where it has been arranged that the pin 10 is to remain until the last by fixedly bonding the pin 10 to the welding gas vent hole, or where the shield plate 11 has been used instead of the pin 10 as illustrated in FIG. 9B, the pin 10 removing step is unnecessary.

Next, in step Sll, the frame 1 that has been finished is packaged. And, the packaged frame 1 for use in the color selection mechanism is transferred to the manufacturing process of the cathode ray tube, namely to the manufacturing process of this color selection mechanism.

In the above-described way, it is possible to manufacture the frame 1 illustrated in FIG. 6.

The frame of the cathode ray tube, the color selection mechanism of the cathode ray tube, the cathode ray tube, and the manufacturing method of the frame for use in the cathode ray tube, of the present invention are not limited to the above-described embodiment. The present invention permits various constructions to be made without departing from the subject matter of the invention. For example, the present invention can also be applied to a shadow-mask type cathode ray tube having transmission apertures discontinuously formed therein.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A frame for use in a color selection mechanism of a cathode ray tube, the frame having mounted thereover a color sorting electrode thin plate of the cathode ray tube, the frame comprising:

a pair of mutually opposing supporting members that has fixedly mounted thereover the color sorting electrode thin plate;

elasticity-imparted members each bridged over the corresponding to ends of the supporting members, and a welding gas degassing vent hole that is formed at a position of the supporting member at which the elasticity-imparted member is welded thereto.

2. A frame for use in a color selection mechanism of a cathode ray tube according to claim 1, wherein:

the welding gas degassing vent hole is located almost right above a center of the end surface, becoming a joint portion of the elasticity-imparted member.

3. A frame for use in a color selection mechanism of a cathode ray tube according to claim 1, wherein the welding gas degassing vent hole is kept closed.

4. A color selection mechanism of a cathode ray tube, the color selection mechanism having a frame that has mounted thereover a color sorting electrode thin plate, the frame comprising:

a pair of mutually opposing supporting members that has fixedly mounted thereover the color sorting electrode thin plate;

elasticity-imparted members each bridged over the corresponding ends of the supporting members, and a welding gas degassing vent hole that is formed at a position of the supporting member at which the elasticity-imparted member is welded thereto.

5. A cathode ray tube with a color selection mechanism having a frame that has mounted thereover a color sorting electrode thin plate, the frame comprising:

a pair of mutually opposing supporting members that has fixedly mounted thereover the color sorting electrode thin plate;

elasticity-imparted members each bridged over the corresponding ends of the supporting members; and a welding gas degassing vent hole that is formed at a position of the supporting member at which the elasticity-imparted member is welded thereto.

6. A method of manufacturing a frame for use in a color selection mechanism of a cathode ray tube, the method comprising:

a step of forming a welding gas degassing vent hole at each of joint portion the supporting members to elasticity-imparted members;

a step of welding the elasticity-imparted members to the supporting members; and a step of closing the welding gas degassing vent hole after the execution of the welding step.

* * * * *

UNITED STATES PATENT AND TRADEMARK OFFICE

CERTIFICATE OF CORRECTION

PATENT NO. : 6,339,283 B1
DATED : January 15, 2002
INVENTOR(S) : Yoshiro Horiuchi It is certified that error appears in the above-identified patent and that said Letters Patent is hereby corrected as shown below:

Title page,
Item [57], ABSTRACT,
Line 5, delete the word "one".
Line 13, replace the second "a" with -- the --.

Column 8,
Line 41, delete the word "to".

Signed and Sealed this

Twenty-third Day of April, 2002

*Attest:*

*Attesting Officer*

JAMES E. ROGAN
*Director of the United States Patent and Trademark Office*